US008720140B2

(12) United States Patent
Petta

(10) Patent No.: US 8,720,140 B2
(45) Date of Patent: May 13, 2014

(54) SYNTHETIC DECK PANEL

(75) Inventor: Gabriel Petta, Woodbridge (CA)

(73) Assignee: Alpa Lumber Inc., Mississauga (CA)

( * ) Notice: Subject to any disclaimer, the term of this patent is extended or adjusted under 35 U.S.C. 154(b) by 0 days.

(21) Appl. No.: 13/363,745

(22) Filed: Feb. 1, 2012

(65) Prior Publication Data

US 2012/0192515 A1 Aug. 2, 2012

(30) Foreign Application Priority Data

Feb. 1, 2011 (CA) ..... 2731003

(51) Int. Cl.
*E04B 1/70* (2006.01)
*E04F 17/00* (2006.01)

(52) U.S. Cl.
USPC ..... 52/302.3; 52/592.1

(58) Field of Classification Search
USPC ..... 52/177, 180, 181, 302.1, 302.3, 302.4, 52/474, 480, 483.1, 578, 580, 581, 588.1, 52/589.1, 592.1
See application file for complete search history.

(56) References Cited

U.S. PATENT DOCUMENTS

| | | | | | |
|---|---|---|---|---|---|
| 3,999,346 | A * | 12/1976 | Fetherston | | 52/474 |
| 5,050,362 | A | 9/1991 | Tal et al. | | |
| D366,943 | S * | 2/1996 | Sheehy | | D25/138 |
| 5,613,339 | A | 3/1997 | Pollock | | |
| 5,647,184 | A | 7/1997 | Davis | | |
| 5,819,491 | A | 10/1998 | Davis | | |
| 5,956,290 | A | 9/1999 | Matsuzaki | | |
| 6,199,340 | B1 | 3/2001 | Davis | | |
| 6,226,950 | B1 | 5/2001 | Davis | | |
| 6,324,796 | B1 * | 12/2001 | Heath | | 52/177 |
| 6,637,163 | B2 * | 10/2003 | Thibault et al. | | 52/177 |
| 6,918,221 | B2 | 7/2005 | Williams | | |
| 7,520,092 | B2 | 4/2009 | Showers et al. | | |
| RE41,140 | E * | 2/2010 | Heath | | 52/177 |
| 2003/0019171 | A1 * | 1/2003 | Thibault et al. | | 52/177 |
| 2004/0025464 | A1 * | 2/2004 | Williams | | 52/483.1 |

FOREIGN PATENT DOCUMENTS

| | | |
|---|---|---|
| CA | 2238453 | 2/1999 |
| CA | 2326252 | 3/2001 |
| CA | 2300565 | 1/2004 |

* cited by examiner

*Primary Examiner* — Basil Katcheves
*Assistant Examiner* — Theodore Adamos
(74) *Attorney, Agent, or Firm* — Bereskin & Parr LLP/S.E.N.C.R.L., s.r.l.

(57) ABSTRACT

An extruded synthetic deck panel includes an elongate plank portion having a plank portion top surface and a plank portion bottom surface, and a first side and a second side spaced apart from the first side, the first and second sides extending lengthwise of the plank portion. A first engagement member extends laterally outwardly from the first side of the plank portion and lengthwise along the plank portion, the first engagement member including a plurality of first holes therethrough for drainage through the first engagement member, the first holes spaced apart lengthwise along the first engagement member. A second engagement member for inter-engaging with the first engagement member of an adjacent like deck panel extends laterally outwardly from the second side of the plank portion and lengthwise along the plank portion, the second engagement member comprising a fastening strip extending laterally away from the plank portion.

13 Claims, 10 Drawing Sheets

SYNTHETIC DECK PANEL

This application claims the benefit of Canadian Application Serial No. 2,731,003, filed Feb. 1, 2011, which is hereby incorporated herein by reference.

FIELD

The teachings herein relate to synthetic deck panels and accessories and to decking structures and methods of making decking structures that include synthetic deck panels.

BACKGROUND

U.S. Pat. No. 6,918,221 (Williams) discloses a deck panel that includes a generally planar body portion having an upper surface and first and second side surfaces on opposed sides of the upper surface. An elongated tongue extends outwardly from and along the first side surface. An elongated groove is defined in and extends along the second side surface, the groove being adapted to receive a second tongue. The deck panel is formed of a polymeric material.

U.S. Pat. No. 5,647,186 (Davis) discloses an elongate modular decking plank that is provided for being assembled on a supporting subfloor together with a plurality of like planks to form a decking structure. The decking plank has a top wall a spaced-apart from a bottom wall, and opposing laterally spaced sidewalls interconnecting the top and bottom walls. An integrally-formed fastening flange extends outwardly from the bottom wall on one of first and second sides of the decking plank. The flange includes a fastening portion for receiving fasteners therethrough to the supporting subfloor to mount the decking plank on the supporting subfloor. The plank is preferably extruded of a high-impact polymeric material, such as PVC plastic.

C.A. Pat. No. 2,300,565 (Davis) discloses a modular cladding element that cooperates with an assembly of cladding elements to clad a surface on an underlying surface. The cladding element includes a cladding panel having opposed inside and outside major surfaces, first and second opposed sides, and first and second opposed ends. A removable male fastener is integrally formed along the first side of the panel, and is adapted for entering a complementary fastener of an adjacent cladding element when positioned on the first side of the panel. The male fastener is removable in the absence of a complementary cladding element position on the first side of the panel. A first female fastener is integrally formed along the opposed second side of the panel, and defines a first opening adapted for receiving a complementary fastener of an adjacent cladding element positioned on the second side of the panel. Upon removing the male fastener, the second female fastener defines a second opening adapted for receiving a complementary fastener of an adjacent cladding element on the first side of the panel.

SUMMARY

This summary is intended to introduce the reader to various aspects of the applicant's teaching, but not to define any invention. In general, disclosed herein are one or more methods or apparatuses related to decks typically provided in a residential setting for supporting patio furniture and the like.

According to some aspects, an extruded synthetic deck panel comprises: a) an elongate plank portion having a plank portion top surface and a plank portion bottom surface spaced apart from the top surface, and a first side and a second side spaced apart from the first side, the first and second sides extending lengthwise of the plank portion; b) a first engagement member extending laterally outwardly from the first side of the plank portion and lengthwise along the plank portion, the first engagement member including a plurality of first holes therethrough for drainage through the first engagement member, the first holes spaced apart lengthwise along the first engagement member; and c) a second engagement member for inter-engaging with the first engagement member of an adjacent like deck panel, the second engagement member extending laterally outwardly from the second side of the plank portion and lengthwise along the plank portion, the second engagement member comprising a fastening strip extending laterally away from the plank portion, the fastening strip comprising a lower strip surface generally coplanar with the plank portion bottom surface.

In some examples, the first engagement member may comprise a laterally protruding tab, the first holes passing through the tab. The first engagement member may comprise a tab support portion laterally intermediate the tab and the first side of the plank portion. The tab support portion may comprise a tab support portion outer sidewall extending generally vertically between respective distal ends of a tab support portion upper surface and a tab support portion lower surface, the tab support portion upper surface generally coplanar with the plank portion top surface. The tab may be vertically positioned at an elevation below the plank portion top surface and above the plank portion bottom surface.

In some examples, the first side of the plank portion may comprise a first sidewall connecting together the plank portion top surface and the plank portion bottom surface, the first sidewall disposed in a first generally vertical continuous plane. The tab support portion lower surface may extend in a continuous plane between the tab support portion outer sidewall and the first sidewall of the plank portion. In some examples, the first engagement member may comprise a notch having a closed notch top bounded by the tab support portion lower surface and a closed notch proximal side bounded by the plank portion first sidewall, and the notch having an open notch distal side opposite the notch proximal side and an open notch bottom opposite the closed notch top.

In some examples, the fastening strip may further comprise a plurality of second holes extending through the fastening strip, at least some of the second holes defining fastener holes that are spaced apart lengthwise along the fastening strip by a spacing that corresponds to a standard joist spacing between joists of an underlying support structure, wherein a fastener is insertable through the fastener holes for securing the fastening strip to the joists. The fastening strip may further comprise an upper strip surface against which an underside surface of the fastener is configured to bear for securing the fastening strip to the joists. At least some others of the second holes may define drainage holes disposed lengthwise between the fastener holes.

In some examples, the second engagement member may comprise a recess housing portion disposed laterally between the plank portion and the fastening strip. The recess housing portion may include a recess housing portion top surface generally coplanar with the plank portion top surface and a recess housing portion bottom surface generally coplanar with plank portion bottom surface. The second engagement member may comprise a recess in the recess housing portion, the recess extending laterally inwardly towards the plank portion, the recess receiving the tab of the adjacent like deck panel when the first engagement member thereof inter-engages the second engagement member. The recess may comprise a generally vertical closed proximal sidewall and an opening opposite the closed proximal sidewall.

In some examples, the second side of the plank portion may comprise a second sidewall connecting together the plank portion top surface and the plank portion bottom surface, the second sidewall disposed in a second generally vertical continuous plane. The closed proximal sidewall of the recess may comprise a vertically intermediate portion of the plank portion second sidewall. The recess housing portion may comprises a recess housing portion lower outer sidewall extending upwardly from a distal end of the recess housing portion bottom surface. A lower surface of the recess may be bounded by a lower recess wall that extends laterally outwardly and at a downward incline from the closed proximal sidewall to an upper end of the lower outer sidewall.

According to some aspects, a deck panel comprises: a) an elongate plank portion having a plank portion top surface and a plank portion bottom surface spaced apart from the top surface, and a first side and a second side spaced apart from the first side, the first and second sides extending lengthwise of the plank portion; b) a first engagement member extending laterally outwardly from the first side of the plank portion and lengthwise along the plank portion, the first engagement member including a plurality of first holes therethrough for drainage through the first engagement member, the first holes spaced apart lengthwise along the first engagement member; c) a second engagement member for inter-engaging with the first engagement member of an adjacent like deck panel, the second engagement member extending laterally outwardly from the second side of the plank portion and lengthwise along the plank portion, the second engagement member comprising a fastening strip extending laterally away from the plank portion, the fastening strip comprising a lower strip surface generally coplanar with the plank portion bottom surface; d) the first engagement member comprises a laterally protruding tab, the first holes passing through the tab, and the first engagement member further including a tab support portion laterally intermediate the tab and the first side of the plank portion, the tab support portion comprising a tab support portion outer sidewall extending generally vertically between respective distal ends of a tab support portion upper surface and a tab support portion lower surface, the tab support portion upper surface generally coplanar with the plank portion top surface; e) the first side of the plank portion comprises a first sidewall connecting together the plank portion top surface and the plank portion bottom surface, the first sidewall disposed in a first generally vertical continuous plane; f) the first engagement member further comprises a notch having a closed notch top bounded by the tab support portion lower surface and a closed notch proximal side bounded by the plank portion first sidewall, the notch having an open notch distal side opposite the closed notch proximal side and an open notch bottom opposite the closed notch top; g) the second engagement member comprises a recess housing portion disposed laterally between the plank portion and the fastening strip, the recess housing portion including a recess housing portion top surface generally coplanar with the plank portion top surface and a recess housing portion bottom surface generally coplanar with plank portion bottom surface; h) the second engagement member comprises a recess in the recess housing portion, the recess extending laterally inwardly towards the plank portion, the recess receiving the tab of the adjacent like deck panel when the first engagement member thereof inter-engages the second engagement member, the recess comprising a generally vertical closed proximal sidewall and an opening opposite the closed proximal sidewall; and wherein the deck panel further comprises: i) a first lateral dimension defined by the lateral distance from the closed notch proximal side to a distal end of the tab and a second lateral dimension defined by the lateral distance from the closed proximal sidewall of the recess to a distal end of the fastening strip, the first lateral dimension greater than the second lateral dimension wherein upon inter-engaging the second engagement member with the first engagement member of the adjacent panel, the distal end of the tab abuts the closed proximal sidewall of the recess and the distal end of the fastening strip is laterally spaced apart from the closed side of the notch to provide a lower gap therebetween.

In some examples, the recess housing portion top surface has a third lateral extent defining a third lateral dimension, and the tab support portion upper surface has a fourth lateral extent defining a fourth lateral dimension, the sum of the third and fourth lateral dimensions being less than the first lateral dimension, wherein an upper gap is provided between a distal edge of the recess housing portion upper surface and the distal end of the tab support portion upper surface of the adjacent panel when the first engagement member thereof is inter-engaged with the second engagement member.

According to some examples, an extruded synthetic deck panel comprises: a) an elongate plank portion of generally rectangular cross-section, the plank portion including a generally horizontal plank top wall and plank bottom wall spaced apart from the top wall, and a generally vertical first side wall and second side wall spaced apart from the first side wall, the first and second side walls extending vertically between, and connecting together, the top and bottom walls of the plank portion adjacent horizontally opposing sides thereof; b) a first engagement member protruding laterally outwardly from the first sidewall and extending lengthwise therealong, the first engagement member including a plurality of first holes therethrough for drainage through the first engagement member, the first holes spaced apart lengthwise along the first engagement member; and c) a second engagement member protruding laterally outwardly from the second side wall for inter-engaging with the first engagement member of an adjacent like deck panel, the second engagement member including a plurality of second holes therethrough, the second holes spaced apart lengthwise along the second engagement member.

In some examples, the first engagement member may comprise a laterally protruding tab, the first holes passing through the tab. The first engagement member may comprise a tab support portion laterally intermediate the tab and the first side of the plank portion. The tab support portion may comprises a tab support portion outer sidewall extending generally vertically between respective distal ends of a tab support portion upper surface and a tab support portion lower surface, the tab support portion upper surface generally coplanar with the plank portion upper surface. The tab may be vertically positioned at an elevation below the plank portion upper surface and above the plank portion bottom surface.

The first side of the plank portion may comprise a first sidewall connecting together the plank portion top surface and the plank portion bottom surface, the first sidewall disposed in a first generally vertical continuous plane. The tab support portion lower surface may extend in a continuous plane between the tab support portion outer sidewall and the first sidewall of the plank portion.

In some examples, the first engagement portion may comprise a notch having a closed notch top bounded by the tab support portion lower surface and a closed notch proximal side bounded by the plank portion first sidewall. The notch may have an open notch distal side opposite the notch proximal side and an open notch bottom opposite the closed notch top.

The second engagement portion may comprise a fastening strip having a lower strip surface generally coplanar with the bottom surface of the plank portion. Upon engagement of the second engagement portion with the first engagement portion of an adjacent panel, the fastening strip of the adjacent panel may generally close off the open notch bottom.

In some examples, the plurality of second holes may extend through the fastening strip, and at least some of the second holes may define fastener holes that are spaced apart lengthwise along the fastening strip by a spacing that corresponds to a standard joist spacing between joists of an underlying support structure. A fastener may be insertable through the fastener holes for securing the fastening strip to the joists. The fastening strip may further comprise an upper strip surface against which an underside surface of the fastener can bear for securing the fastening strip to the joists. At least some others of the second holes may define drainage holes disposed lengthwise between the fastener holes.

In some examples, the second engagement member may comprise a recess housing portion disposed laterally between the plank portion and the fastening strip, the recess housing portion including a recess housing portion top surface generally coplanar with the plank portion top surface and a recess housing portion bottom surface generally coplanar with plank portion bottom surface. The second engagement portion may comprise a recess in the recess housing portion, the recess extending laterally inwardly towards the plank portion, the recess receiving the tab of the adjacent like deck panel when the first engagement member thereof inter-engages the second engagement member. The recess may comprise a generally vertical closed proximal sidewall and an opening opposite the closed proximal sidewall. The second side of the plank portion may comprise a second sidewall connecting together the plank portion top surface and the plank portion bottom surface, the second sidewall disposed in a second generally vertical continuous plane. The closed proximal sidewall of the recess may comprise a vertically intermediate portion of the plank portion second sidewall. The recess housing portion may comprise a recess portion lower outer sidewall extending upwardly from a distal end of the recess bottom surface, and wherein a lower surface of the recess is bounded by a lower recess wall that extends laterally outwardly and at a downward incline from the closed proximal sidewall to an upper end of the lower outer sidewall.

According to some aspects, an extruded synthetic deck panel comprises: a) an elongate plank portion of generally rectangular cross-section, the plank portion including a generally horizontal plank top wall and plank portion bottom wall spaced apart from the top wall, and a generally vertical first side wall and second side wall spaced apart from the first side wall, the first and second side walls extending vertically between, and connecting together, the top and bottom walls of the plank portion adjacent horizontally opposing sides thereof; b) a first engagement member extending laterally outwardly from the first side wall of the plank portion and lengthwise along the plank portion, the first engagement member including a laterally protruding tab and a plurality of first holes through the tab for drainage through the first engagement member, the first holes spaced apart lengthwise along the first engagement member; and c) a second engagement member for inter-engaging with the first engagement member of an adjacent like deck panel, the second engagement member extending laterally outwardly from the second side wall of the plank portion and lengthwise along the plank portion, the second engagement member including a fastening strip protruding laterally away from the plank portion, the fastening strip comprising a lower strip surface generally coplanar with the bottom surface of the plank portion and a plurality of second holes extending through the fastening strip, at least some of the second holes defining fastener holes that are spaced apart lengthwise along the fastening strip by a spacing that corresponds to a standard joist spacing between joists of an underlying support structure, wherein a fastener is insertable through the fastener holes for securing the fastening strip to the joists.

According to some aspects, a deck assembly comprises: a) a plurality of like extruded synthetic deck panels, the plurality of deck panels including first and second deck panels arranged in generally horizontal adjacent relation, each deck panel comprising: an elongate plank portion having a plank portion top surface and a plank portion bottom surface spaced apart from the top surface, and a first side and a second side spaced laterally apart from each other, the first and second sides extending lengthwise of the plank portion; a first engagement member extending laterally outwardly from the first side of the plank portion and lengthwise along the plank portion, the first engagement member including a laterally protruding tab extending away from the plank portion; and a second engagement member extending laterally outwardly from the second side of the plank portion and lengthwise along the plank portion, the second engagement member comprising a recess and a fastening strip extending laterally away from the plank portion, the fastening strip comprising a lower strip surface generally coplanar with the plank portion bottom surface; wherein the tab of the first engagement member of each second deck panel inter-engages with the recess of the second engagement member of each first deck panel for assembling the panels together to form a deck; and b) a fluid drainage pathway between the first and second adjacent panels for draining away liquid from above the deck assembly to below the deck assembly, each fluid drainage pathway comprising a plurality of first holes in the tab of each deck panel.

In some examples, each fluid drainage pathway may further comprise an upper gap between an upper surface of the second engagement member of each first panel and the first engagement member of each second panel. Each fluid drainage pathway may further comprise a lower gap between the fastening strip of each first panel and a notch sidewall of each second panel. Each fluid drainage pathway may further comprise a plurality of second holes in the fastening strip.

In some examples, the deck assembly may comprise an underlying support structure including spaced-apart joists to which the fastening strip of each second engagement is secured, wherein at least some of the plurality of second holes are spaced intermediate the joists.

In some examples, the first holes may be positioned at least partially beneath the upper gap. Each fluid drainage pathway may comprise a lower recess wall that bounds a bottom side of the recess, the lower recess wall sloped outwardly and downwardly from the plank portion toward the fastening strip so that liquid received on the lower recess wall from the first holes in the tab is directed toward the fastening strip of the second deck panel. The plurality of deck panels may include at least one third deck panel arranged in a generally horizontal plane parallel to the first and second deck panels and vertically offset therefrom by a step height, wherein opposed longitudinally outer ends of the third deck panel are supported by respective stringers. The second side of the third deck panel may be directed away from the inter-engaged first and second panels. The assembly may comprise a tread nosing member having a nosing engagement portion for inter-engaging with the second engagement member of the third deck panel, and a portion opposite the nosing engagement portion. The plurality of deck panels may include at least one fourth deck panel arranged generally vertically as a stair riser, the first end of the fourth deck panel disposed vertically above the second end of the fourth deck panel. The tread nosing member may comprise a flange extending downwardly below the nosing engagement portion and overlying an outer surface of the first engagement portion of the fourth deck panel, and wherein a fastener is received through the flange and fourth deck panel and into the stringer.

BRIEF DESCRIPTION OF THE DRAWINGS

The drawings included herewith are for illustrating various examples of articles, methods, and/or apparatuses that include one or more aspects of the teaching of the present specification and are not intended to limit the scope of what is taught in any way. In the drawings.

DETAILED DESCRIPTION

Various apparatuses or processes will be described below to provide an example of an embodiment of the invention. No embodiment described below limits any claimed invention and any claimed invention may cover apparatuses or methods that differ from those described below. The claimed inventions are not limited to apparatuses or methods having all of the features of any one apparatus described below or to features common to multiple or all of the apparatuses described below. It is possible that an apparatus or method described below is not an embodiment of any claimed invention. Any invention disclosed in an apparatus or method described below that is not claimed in this document may be the subject matter of another protective instrument, for example, a continuing patent application, and the applicants, inventors or owners do not intend to abandon, disclaim or dedicate to the public any such invention by its disclosure in this document.

Figure 1:
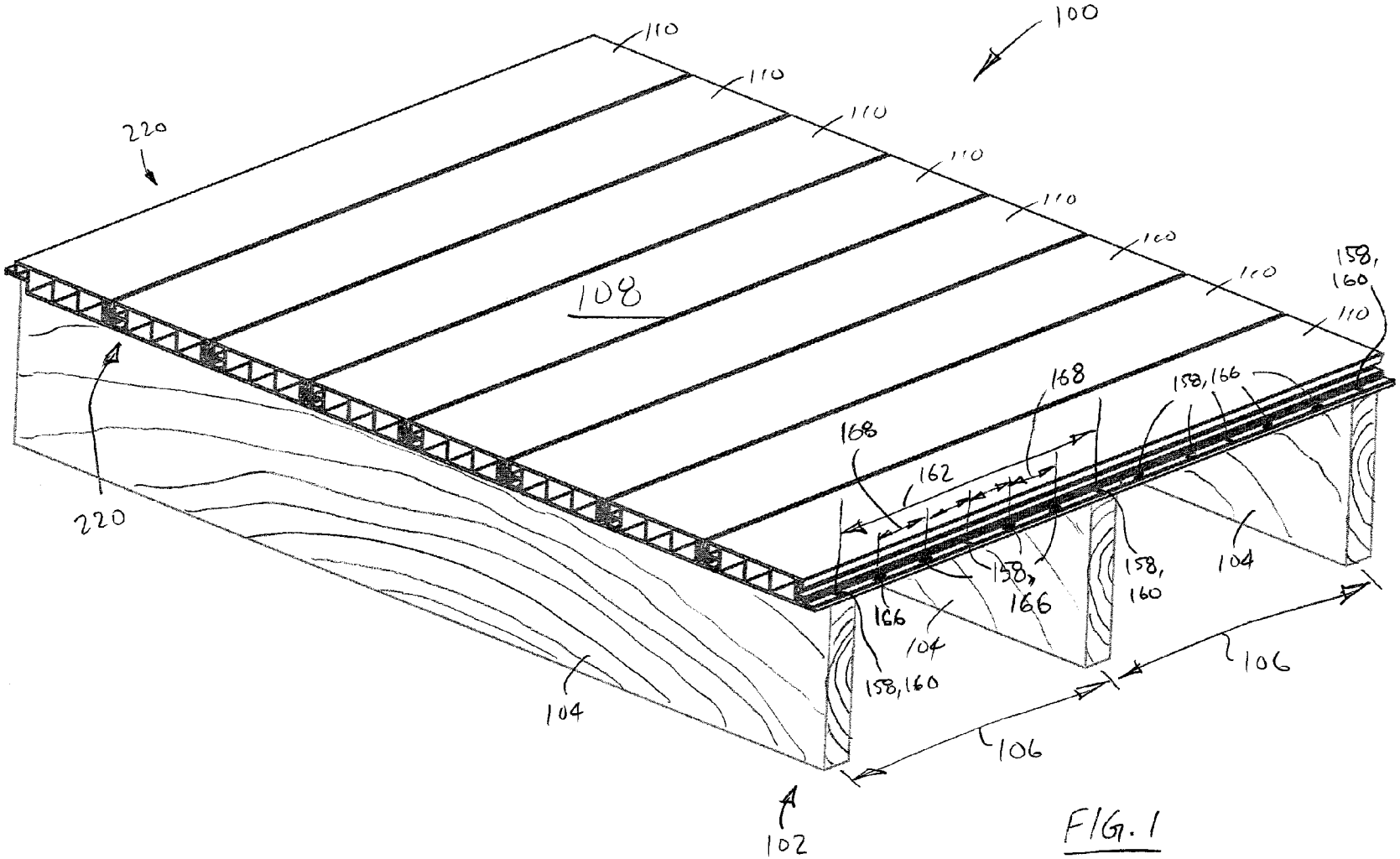
FIG. 1 is an upper perspective view of a deck assembly formed from a plurality of synthetic deck panels.

Referring to FIG. 1, a deck assembly 100 includes a plurality of extruded synthetic deck panels 110 mounted on an underlying support structure 102. The support structure 102 includes a plurality of parallel joists 104 that are spaced apart from each other by a standard joist spacing 106, and are generally perpendicular to the elongate deck panels. The standard joist spacing 106 can be, for example, 12 inches, 18 inches, or 24 inches.

The deck assembly 100 provides a generally horizontal upward facing deck surface 108 upon which furniture can be placed and users can walk or stand. The deck surface 108 may be provided with an optional surface texture or pattern that may be provided in a post-extrusion embossing process. Such texture or pattern can be for aesthetic purposes (for example, to resemble wood grain) and/or to provide improved traction on the deck surface 108.

Figure 2:
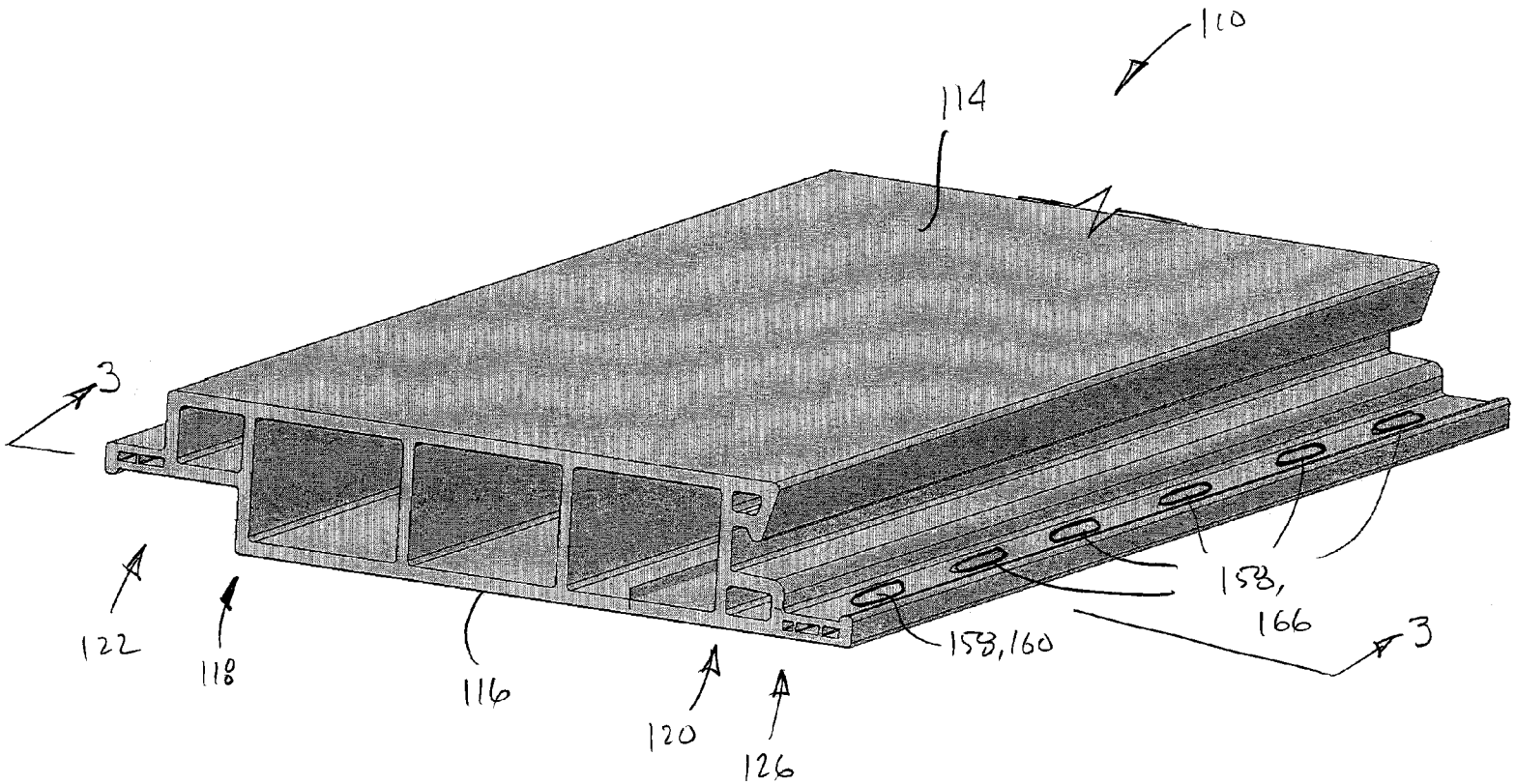
FIG. 2 is a right side perspective view of a deck panel of FIG. 1.
Figure 3:
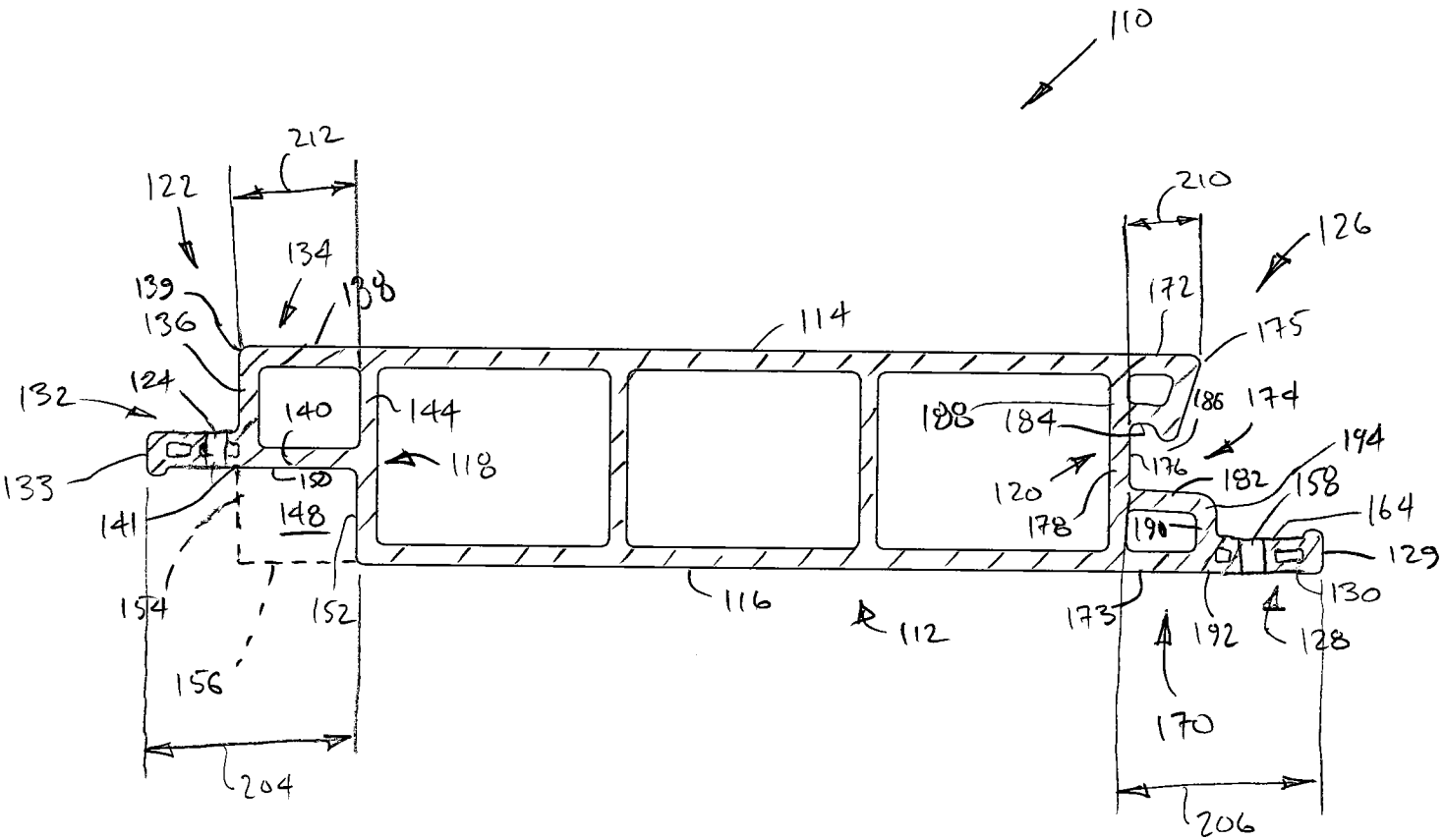
FIG. 3 is a cross-sectional view of the deck panel of FIG. 2 taken along lines 3-3.

Referring to FIGS. 2 and 3, the extruded synthetic deck panel 110 includes an elongate plank portion 112 having a plank portion top surface 114 and a plank portion bottom surface 116 spaced apart from the top surface 114. The plank portion further includes a first side 118 and a second side 120 spaced apart from the first side 118. The first and second sides 118, 120 extend lengthwise of the plank portion.

The deck panel 110 further includes a first engagement member 122 extending laterally outwardly from the first side 118 of the plank portion 112 and lengthwise along the plank portion 112. The first engagement member 122 includes a plurality of first holes 124 therethrough for drainage of liquid (e.g. rain water) through the first engagement member 122. The first holes 124 are, in the example illustrated, spaced apart lengthwise along the first engagement member 122 by a first hole spacing 125 (shown for example at spacing 125*a* with respect to the first panel 11*a* of FIG. 4).

Figure 4:
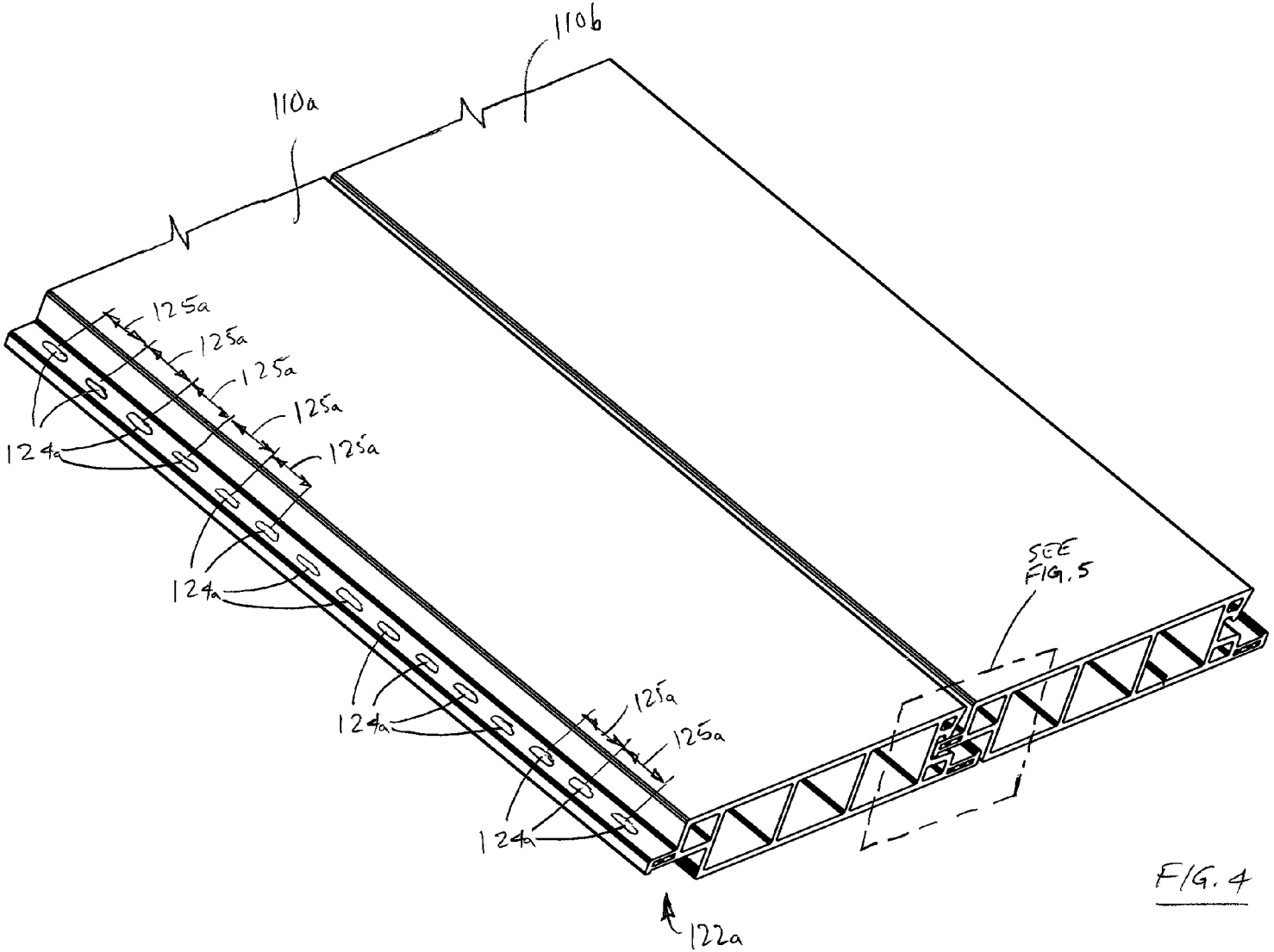
FIG. 4 is a left side perspective view of two of the deck panels of FIG. 2 shown in an inter-engaged, assembled condition.
Figure 5:
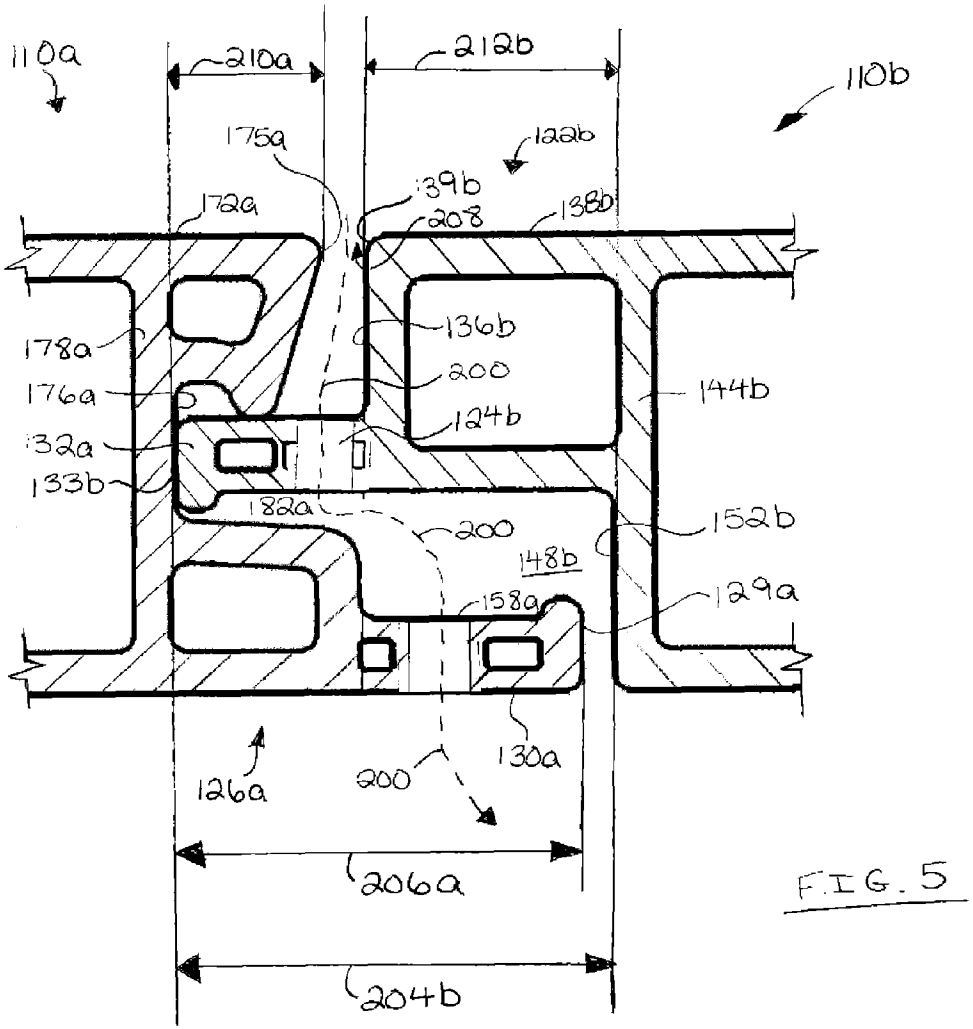
FIG. 5 is an enlarged cross-sectional view of a portion of the deck panels of FIG. 4.

The deck panel 110 further includes a second engagement member 126 for inter-engaging with the first engagement member 122 of an adjacent like deck panel 110 (for example, a second deck panel 110*b* adjacent a first deck panel 110*a* as shown in FIG. 4). The second engagement member 126 extends laterally outwardly from the second side 120 of the plank portion 112 and lengthwise along the plank portion 112. The second engagement member 126 may include a fastening strip 128 extending laterally away from the plank portion 112, to a free distal end 129 of the strip 128. In the example illustrated, the second engagement member includes a fastening strip 128 integrally molded with the panel 110, and having a lower strip surface 130 generally coplanar with the plank portion bottom surface 116.

The first engagement member 122 may comprise a laterally protruding tab 132, with the first holes 124 passing through the tab 132. The tab 132 has a free distal end 133 spaced laterally away from the plank port first side 118. The first holes 124 can be sized and shaped to facilitate the passage of liquid through the holes 124. The first engagement member 122 may further include a tab support portion 134 laterally intermediate the tab 132 and the first side 118 of the plank portion 112. The tab 132 and the tab support portion 134 are, in the example illustrated, integrally molded with the deck panel 110. In the example illustrated, the tab support portion 134 includes a tab support portion outer sidewall 136 extending generally vertically between respective distal ends 139, 141, of a tab support portion upper surface 138 and a tab support portion lower surface 140. The tab support portion upper surface 138 is, in the example illustrated, generally coplanar with the plank portion top surface 114. The tab 132 is, in the example illustrated, vertically positioned at an elevation below the plank portion top surface 114 and above the plank portion bottom surface 116.

The first side 118 of the plank portion 112 may comprise a first sidewall 144 connecting together the plank portion top surface 114 and the plank portion bottom surface 116. In the example illustrated, the first sidewall 144 is disposed in a first generally vertical continuous plane. The tab support portion lower surface 140 extends, in the example illustrated, in a generally horizontal continuous plane between the tab support portion outer sidewall 136 and the first sidewall 144 of the plank portion 112.

In the example illustrated, the first engagement member 122 includes a notch 148 having a closed notch top 150 bounded by the tab support portion lower surface 140 and a closed notch proximal side 152 bounded by the plank portion first sidewall 144. The notch has an open notch distal side 154 opposite the notch proximal side 152 and an open notch bottom 156 opposite the closed notch top 150.

The fastening strip 128 of the second engagement member 126 may optionally include a plurality of second holes 158 extending through the fastening strip 128. At least some of the second holes 158 can define fastener holes 160 that are spaced apart lengthwise along the fastening strip 128 by a fastener hole spacing 162 that corresponds to the standard joist spacing 106 between the joists 104 of the underlying support structure 102 (see FIG. 1). A fastener (e.g. screw 105—FIG. 7) is insertable through the fastener holes 160 for securing the fastening strip 128 to the joists 104. In the example illustrated, the fastening strip 128 has a fastening strip upper surface 164 against which an underside surface of the fastener is configured to bear for securing the fastening strip 128 to the joists 104. At least some others of the second holes 158 may define drainage holes 166 disposed lengthwise between the fastener holes 160 (and spaced apart from the joists of the underlying support structure). The drainage holes 166 can be spaced apart by a drainage hole spacing 168. The fastener hole spacing 162 can be a multiple of the drainage hole spacing 168. In the example illustrated, the drainage hole spacing 168 is about 2 inches, and the fastener holes spacing (as well as the joist spacing 106) is about 12 inches.

The second engagement member 126 may include a recess housing portion 170 disposed laterally between the plank portion 112 and the fastening strip 128. In the example illustrated, the recess housing portion 170 includes a recess housing portion top surface 172 generally coplanar with the plank portion top surface 114 and a recess housing portion bottom surface 173 generally coplanar with plank portion bottom surface 116. The recess housing portion top surface is 172 generally terminates at a distal edge 175. The recess housing portion bottom surface 173 is, in the example illustrate, positioned laterally intermediate of, and generally coplanar with, the plank portion bottom surface 116 and the fastening strip lower surface 130.

The second engagement member 126 further includes, in the example illustrated, a recess 174 in the recess housing portion 170. The recess 174 receives at least a portion of the tab of the adjacent like deck panel when the first engagement member thereof inter-engages the second engagement member 126. In the example illustrated, the recess 174 extends laterally inwardly towards the plank portion 112. The recess 174 has a closed recess side 176 that is closed by a generally vertical proximal recess sidewall 178 and a recess opening 180 opposite the proximal recess sidewall 178. A lower surface of the recess 174 is bounded by a recess lower wall 182, and an upper surface of the recess is bounded by a recess upper wall 184. The recess upper wall 184, proximal recess sidewall 178, and recess lower wall 182 form a generally C-shaped recess enclosure. The recess lower wall can be inclined downwardly (in a laterally outwardly direction) to help inhibit any liquid that has drained through the first holes 124 from collecting underneath the tab 132. Such liquid is, in the example illustrated, urged to drain laterally outwardly toward the fastening strip 128.

In the example illustrated, the second side 120 of the plank portion 112 comprises a plank portion second sidewall 188 connecting together the plank portion top surface 114 and the plank portion bottom surface 116. The plank portion second sidewall 188 is, in the example illustrated, disposed in a second generally vertical continuous plane, parallel to, and spaced laterally apart from, the first vertical plane. The closed proximal sidewall 178 of the recess 174 may comprise a vertically intermediate portion of the plank portion second sidewall 188. In the example illustrated, the recess housing portion 170 includes a recess housing portion lower outer sidewall 190 extending upwardly from a distal end 192 of the recess housing portion bottom surface 173. The recess lower wall 182 extends, in the example illustrated, laterally outwardly and at a downward incline from a lower end of the closed proximal sidewall 178 to an upper end 194 of the lower outer sidewall 190.

In use, a plurality of the deck panels 110 can be assembled in inter-engaging relation to form the deck assembly 100. For clarity of explanation, the assembly is described with relation to two representative ones of the deck panels 110, identified as first deck panel 110*a* and second deck panel 110*b*. Each of the first and second deck panels 110*a*, 110*b* have the features of the deck panel 110, with the suffix "a" and "b", added, respectively, to the corresponding reference character of the deck panel 110.

The first deck panel 110*a* can be positioned in a desired location on the underlying support structure 102 and secured in place by installing fasteners (such as, for example, screws, nails, or staples) through the fastening strip and into the joists. The fasteners can pass through respective ones of the second holes 158 in the fastening strip 128 that are in registration with the joists 104.

Installation of the second plank 110*b* includes, in the example illustrated, inserting the tab 132*b* of the first engagement member 122*b* of the second plank 110*b* into the recess 174*a* of the second engagement member 126*a* of the first plank 110*a* to bring the first engagement member 122*b* into engagement with the second engagement member 126*a*. The notch 148*b* of the second plank 110*b* accommodates the fastening strip 128*a*, and may accommodate any protruding elements of the fasteners installed through the strip. In the example illustrated, when in the engaged position, the distal end 133*b* of the tab 132*b* generally abuts the closed proximal sidewall 176*a* of the recess 174*a*. This engagement along the length of the deck panels 110*a*, 110*b* can facilitate parallel alignment of the second plank 110*b* relative to the first plank 110*a*. Once so positioned, additional fasteners can be inserted through the fastener strip 128*b* of the second plank 110*b* to secure the second plank 110*b* to the underlying support structure 102. Additional deck planks 110 may be installed in a similar manner, providing a deck assembly of desired size.

The deck assembly 100 may be provided with at least one fluid drainage pathway 200 between the first and second adjacent panels 110*a*, 110*b* for draining away liquid from above the deck assembly 100 to below the deck assembly 100. One or more of the fluid drainage pathways 200 may include one or more of the first holes 124 in the tab 132 of each deck panel 110. In the example illustrated, the fluid drainage pathway 200 includes the first holes 124*b* in the tab 132*b* of the second deck panel 110*b*.

One or more of the fluid drainage pathways 20 may further comprise one or more of the second holes 158 in the fastening strip 129 of each deck panel 110. In the example illustrated, the fluid drainage pathway 200 includes at least some of the second holes 158*a* in the fastening strip 128*a* of the first deck panel 110*a*.

Alternatively or additionally, a lower gap 202 may be provided between the distal end 129*a* of the fastening strip 128*a* of the first deck panel 110*a* and an adjacent surface of the second deck panel 110*b*. In the example illustrated, each deck panel 110 has a first lateral dimension 204 defined by the lateral distance from the closed notch proximal side 152 to the distal end 133 of the tab 132, and a second lateral dimension 206 defined by the lateral distance from the closed proximal sidewall 176 of the recess 174 to the distal end 129 of the fastening strip 128. The first lateral dimension 204 is, in the example illustrated, greater than the second lateral dimension 206. Upon inter-engagement of the first and second engagement portions 122*b*, 126*a*, when the distal end 133*b* of the tab 132*b* abuts the closed proximal sidewall 176*a* of the recess 174*a*, the distal end 129*a* of the fastening strip 128*a* is laterally spaced apart from the closed notch proximal side 152*b* of the notch 148*b* to provide the lower gap 202 between the distal end 129*a* of the fastening strip 128*a* and the closed proximal side 152*b* of the notch 148*b*.

One or more of the fluid pathways 200 may further comprise an upper gap 208 between the first and second deck panels 110*a*, 110*b*. In the example illustrated, the recess housing portion top surface 172 of each deck panel 110 has a third lateral extent (between the point where the second plank sidewall generally joins the plank top surface, and the distal end of the recess housing portion top surface), defining a third lateral dimension 210. The tab support portion upper surface 138 has a fourth lateral extent defining a fourth lateral dimension 212. The sum of the third and fourth lateral dimensions 210*a*, 212*b* is, in the example illustrated, less than the first lateral dimension 204*b*, providing the upper gap 208 between the distal edge 175*a* of the recess housing portion top surface 172*a* of the first panel 110*a* and the distal end 139*b* of the tab support portion upper surface 138*b* of the second panel 110*b* when the first engagement member 122*b* thereof is inter-engaged with the second engagement member 126*a*.

The width (lateral extent) of the upper gap 208 may increase with decreasing elevation towards the tab 132. The increasing width of the gap 208 can help draw liquid downward, away from the gap opening coplanar with the deck surface 108. In the example illustrated, the recess housing portion 170 includes a recess housing portion upper outer sidewall 216 extending downwardly from the distal end 175 of the recess housing portion top surface 172. The recess housing portion upper sidewall 216 extends, in the example illustrated, inclines laterally inwardly and downwardly to facilitate providing the increasing gap width.

In the example illustrated, the lateral midpoints of the first holes 124 are spaced laterally apart from the distal end 133 of the tab 132 by an amount generally equal to the third dimension. This can help to vertically align the first holes 124 (or at least a portion of the first holes 124) with the upper gap 208 when two adjacent panels are in an inter-engaged, assembled position. This alignment can facilitate flow of liquid from the upper gap 208 through the first holes 124.

Each fluid drainage pathway 200 may further include the recess lower wall 182 that bounds a bottom side of the recess 174. In the example illustrated, the recess lower wall 182*a* is sloped outwardly and downwardly from the plank portion 112*a* toward the fastening strip 128*a* so that liquid received on the recess lower wall 182*a* from the first holes 124*b* in the tab 132*b* of the second deck panel 110*b* is directed toward the fastening strip 128*a* the first deck panel 110*a*.

Figure 6:
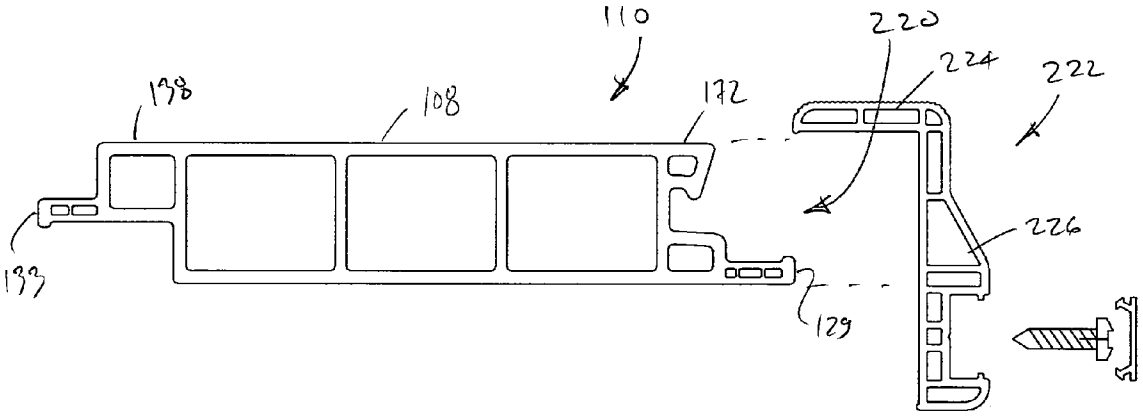
FIGS. 6 and 7 show in an exploded an assembled state, respectively, an end view of the deck panel of FIG. 1 in combination with an edge trim member.
Figure 7:
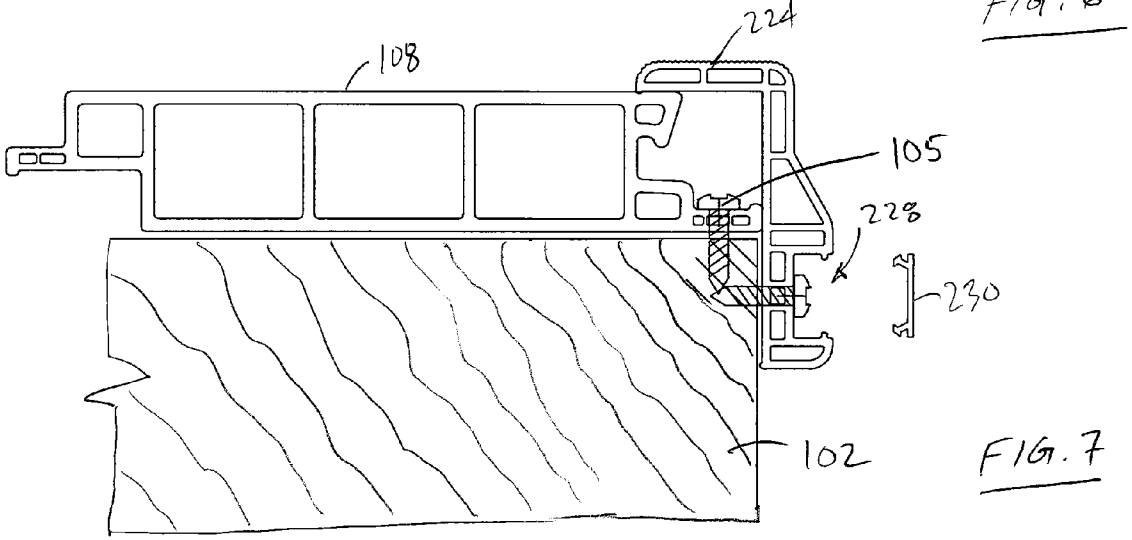

Referring to FIGS. 1, 6, and 7, in some examples, portions of the deck assembly 100 may have exposed edges 220 defined by a longitudinal or transverse edge portion of one or more deck panels 110. The deck assembly 100 can include an edge trim member 222 that can extend the length of the exposed edge 220. In the example illustrated, the edge trim member 222 includes a generally horizontal edge cover portion 224 and a generally vertical flange portion 226 depending downwardly from the cover portion 224. The cover portion 224 has a lateral extent that is sufficient to overlap at least a portion of the tab support portion top surface 134 or the recess housing portion top surface 172 when an inner surface of the flange portion 226 abuts the tab distal end 133 or the fastening strip distal end 129, respectively. The edge trim includes a pocket 228 at a lower portion of the flange portion 226 for accommodating a fastener securing the flange member to the underlying support structure 102. A cap 230 can be snap-fit into the pocket to conceal the fastener.

Figure 8:
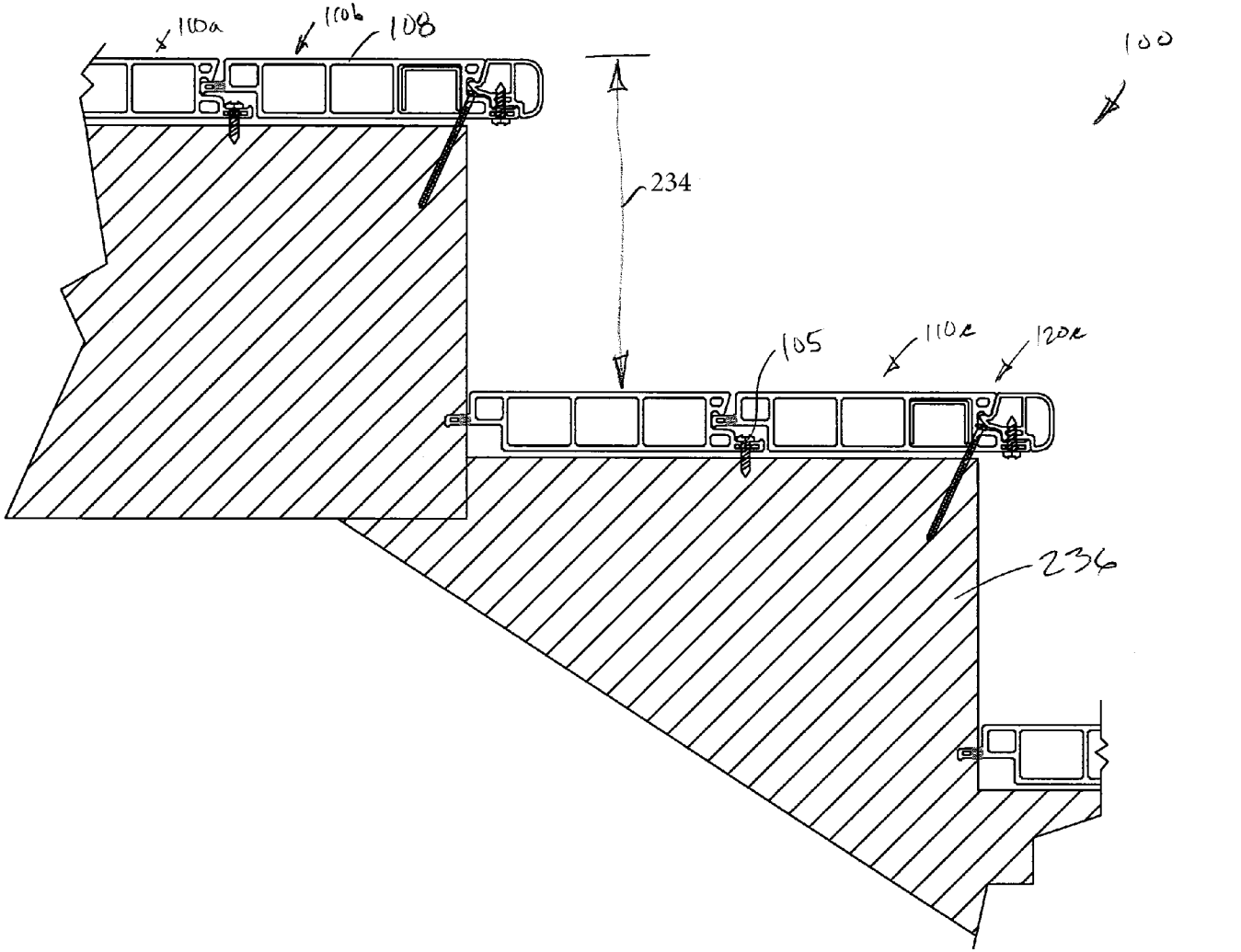
FIG. 8 is an end view of an open-type staircase formed using deck panels of FIG. 2.
Figures 9, 10:
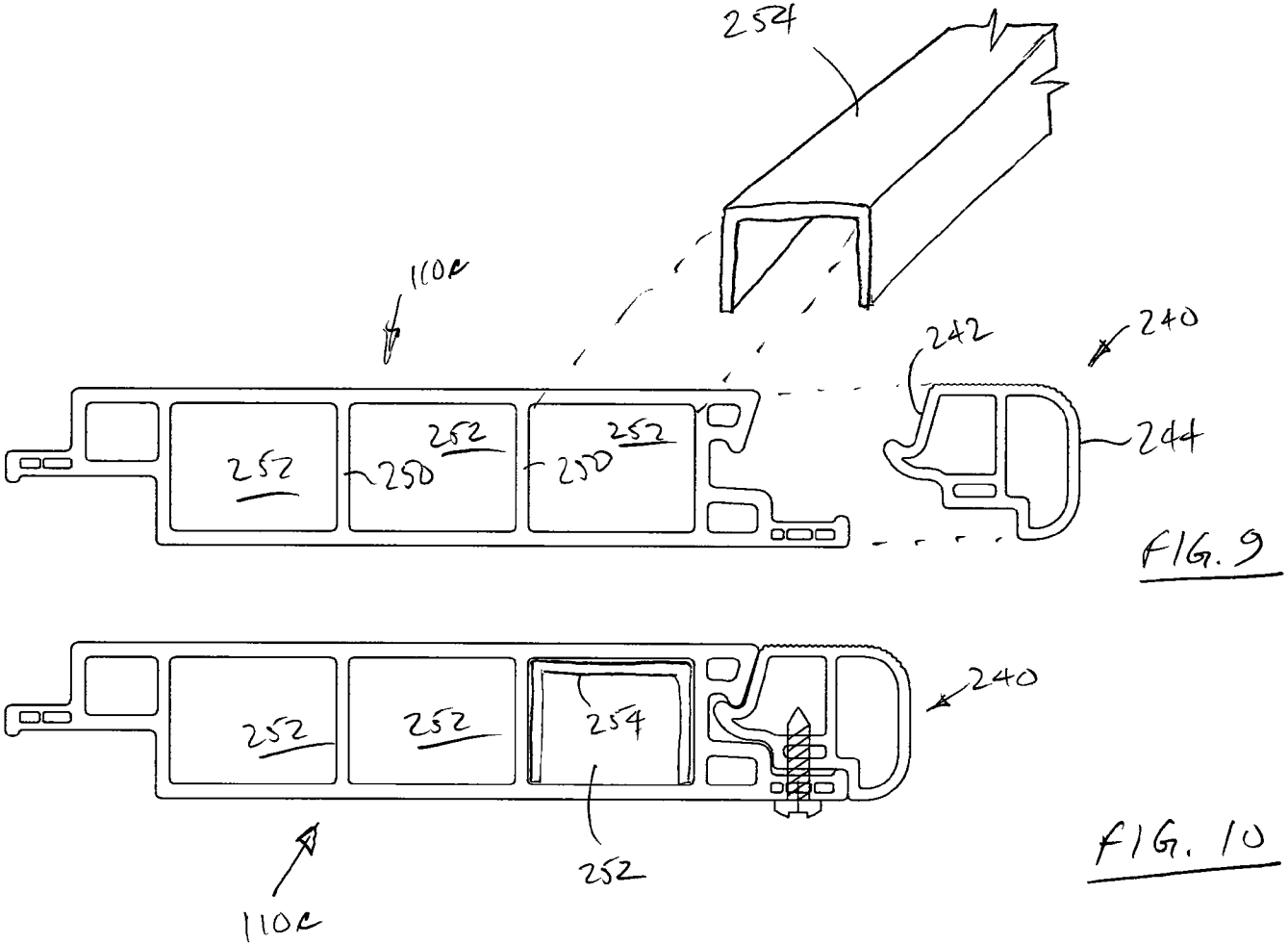
FIGS. 9 and 10 show in an exploded an assembled state, respectively, a deck panel of FIG. 8 in combination with a reinforcement member and tread nosing member.

Referring to FIG. 8, the plurality of deck panels 110 may include at least one third deck panel 110*c* that can serve as a stair tread. In the example illustrated, the third deck panel 110*c* is arranged in a generally horizontal plane parallel to the first and second deck panels 110*a*, 110*b* and vertically offset therefrom by a step height 234. Opposed longitudinally outer ends of the third deck panel 110*c* may be supported by respective stringers 236. The second side 120*c* of the third deck panel 110*c* may be directed laterally away from the inter-engaged first and second panels 110*a*, 110*b*. Referring also to FIGS. 9 and 10, the assembly 100 may comprise a tread nosing member 240 having a nosing engagement portion 242 for inter-engaging with the second engagement member 126*c* of the third deck panel 110*c*. The tread nosing member 240 may have a finial portion 244 opposite the nosing engagement portion 242.

The deck panels 110 may include one or more internal ribs 250 positioned within the plank portion. The interior ribs 250 may be joined between the plank portion top and bottom surfaces, and may be generally parallel to the side walls 144, 188. In the example illustrated, each deck panel 110 has two internal ribs 250. The ribs 250 separate the interior of the plank portion into three cavities 252 spaced laterally side-by-side and extending lengthwise of the panel 110. A reinforcement beam 254 can be housed within one of more of the cavities 252 to provide additional stiffness and strength to the deck panel 110. This can be particularly helpful where the deck panel 110 spans a gap wider than a standard joist spacing, for example, in the case where the risers 236 are spaced apart by a distance of, for example, 24 inches, 36 inches, or more. In the example illustrated, the reinforcement beam 252 comprises a length of roll-formed steel C-channel.

Figure 11:
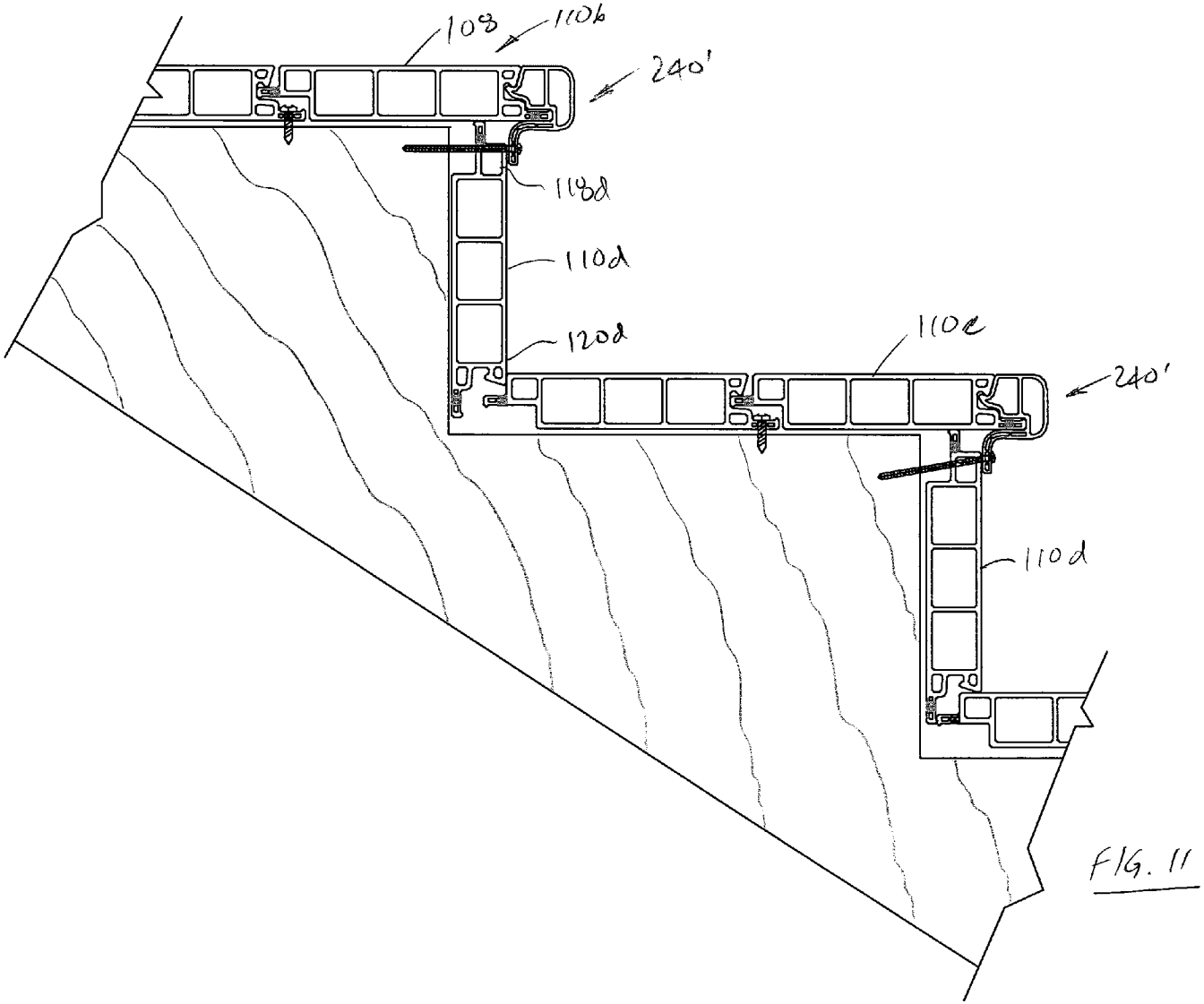
FIG. 11 is an end view of a closed-type staircase formed using deck panels of FIG. 2.
Figures 12, 13:
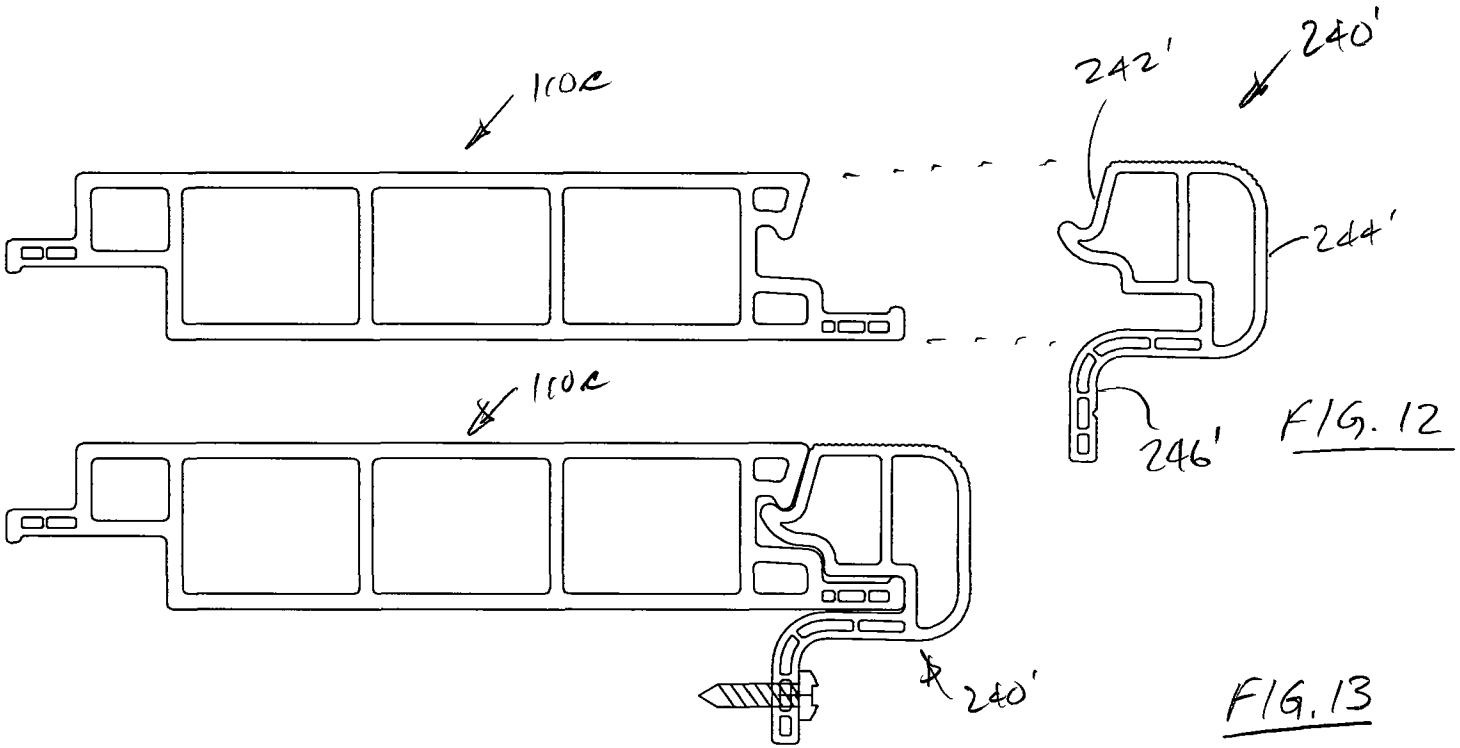
FIGS. 12 and 13 show in an exploded and assembled state, respectively, a deck panel of FIG. 11 in combination with another example of a tread nosing member.

Referring to FIG. 11, the plurality of deck panels 110 may include at least one fourth deck 110*d* panel arranged generally vertically as a stair riser for a closed-type staircase. The first side 118*d* of the fourth deck panel 110*d* may be disposed vertically above the second side 120*d* of the fourth deck panel 110*d*. Referring also to FIGS. 12 and 13, a modified tread nosing member 240' is similar to the tread nosing 240, but includes a downwardly depending flange 246' for securing the nosing member 240' to the riser panel 110*d*. The flange 246' extends downwardly below the nosing engagement portion and overlies an outer surface of the first engagement portion of the fourth deck panel 110*d*. A fastener can be received through the flange and fourth deck panel and into the stringer.

What has been described above has been intended to be illustrative of the invention and non-limiting and it will be understood by persons skilled in the art that other variants and modifications may be made without departing from the scope of the invention as defined in the claims appended hereto.

The invention claimed is:

1. An extruded synthetic deck panel, comprising:

a) an elongate plank portion having a plank portion top surface and a plank portion bottom surface spaced apart from the top surface, and a first side and a second side spaced apart from the first side, the first and second sides extending lengthwise of the plank portion;

b) a first engagement member extending laterally outwardly from the first side of the plank portion and lengthwise along the plank portion, the first engagement member including a plurality of first holes therethrough for drainage through the first engagement member, the first holes spaced apart lengthwise along the first engagement member; and (c) a second engagement member extending laterally outwardly from the second side of the plank portion and lengthwise along the plank portion, the second engagement member comprising a fastening strip extending laterally away from the plank portion, the fastening strip comprising a lower strip surface generally coplanar with the plank portion bottom surface, wherein the second engagement member comprises a recess housing portion disposed laterally between the plank portion and the fastening strip, the recess housing portion including a recess housing portion top surface generally coplanar with the plank portion top surface and a recess housing portion bottom surface generally coplanar with plank portion bottom surface, wherein the second engagement member comprises a recess in the recess housing portion, the recess extending laterally inwardly towards the plank portion, wherein the recess comprises a generally vertical proximal sidewall that closes a back of the recess, and an opening opposite the proximal sidewall, and wherein the recess housing portion comprises a recess housing portion lower outer sidewall extending upwardly from a distal end of the recess housing portion bottom surface, and wherein a lower surface of the recess is bounded by a lower recess wall that extends laterally outwardly and at a downward incline from the closed proximal sidewall to an upper end of the lower outer sidewall.

2. The deck panel of claim 1, wherein the first engagement member comprises a laterally protruding tab, the first holes passing through the tab.

3. The deck panel of claim 2, wherein the first engagement member comprises a tab support portion laterally intermediate the tab and the first side of the plank portion.

4. The deck panel of claim 3, wherein the tab support portion comprises a tab support portion outer sidewall extending generally vertically between respective distal ends of a tab support portion upper surface and a tab support portion lower surface, the tab support portion upper surface generally coplanar with the plank portion top surface.

5. The deck panel of claim 4, wherein the tab is vertically positioned at an elevation below the plank portion top surface and above the plank portion bottom surface.

6. The deck panel of claim 5, wherein the first side of the plank portion comprises a first sidewall connecting together the plank portion top surface and the plank portion bottom surface, the first sidewall disposed in a first generally vertical continuous plane.

7. The deck panel of claim 6, wherein the tab support portion lower surface extends continuously in a horizontal plane between the tab support portion outer sidewall and the first sidewall of the plank portion.

8. The deck panel of claim 6, wherein the first engagement member comprises a notch having a closed notch top bounded by the tab support portion lower surface and a closed notch proximal side bounded by the plank portion first sidewall, and the notch having an open notch distal side opposite the notch proximal side and an open notch bottom opposite the closed notch top.

9. The deck panel of claim 1, wherein the fastening strip further comprises a plurality of second holes extending through the fastening strip, at least some of the second holes defining fastener holes that are spaced apart lengthwise along the fastening strip by a spacing that corresponds to a standard joist spacing between joists of an underlying support structure, wherein a fastener is insertable through the fastener holes for securing the fastening strip to the joists.

10. The deck panel of claim 9, wherein the fastening strip further comprises an upper strip surface against which an underside surface of the fastener is configured to bear for securing the fastening strip to the joists.

11. The deck panel of claim 9, wherein at least some others of the second holes define drainage holes disposed lengthwise between the fastener holes.

12. The deck panel of claim 1, wherein the second side of the plank portion comprises a second sidewall connecting together the plank portion top surface and the plank portion bottom surface, the second sidewall disposed in a second generally vertical continuous plane, and wherein the proximal sidewall of the recess comprises a vertically intermediate portion of the plank portion second sidewall.

13. A deck assembly, comprising:

a) a plurality of deck panels, each formed by extrusion through a common die, the plurality of deck panels including first and second deck panels arranged in generally horizontal adjacent relation, each deck panel comprising:

i) an elongate plank portion having a plank portion top surface and a plank portion bottom surface spaced apart from the top surface, and a first side and a second side spaced laterally apart from each other, the first and second sides extending lengthwise of the plank portion;

ii) a first engagement member extending laterally outwardly from the first side of the plank portion and lengthwise along the plank portion, the first engagement member including a laterally protruding tab extending away from the plank portion; and iii) a second engagement member extending laterally outwardly from the second side of the plank portion and lengthwise along the plank portion, the second engagement member comprising a recess and a fastening strip extending laterally away from the plank portion, the fastening strip comprising a lower strip surface generally coplanar with the plank portion bottom surface;

wherein the tab of the first engagement member of each second deck panel inter-engages with the recess of the second engagement member of each first deck panel for assembling the panels together to form a deck; and (b) a fluid drainage pathway between the first and second adjacent panels for draining away liquid from above the deck assembly to below the deck assembly, each fluid drainage pathway comprising:

(i) a plurality of first holes in the tab of each deck panel, (ii) an upper gap between an upper surface of the second engagement member of each first panel and the first engagement member of each second panel, and (iii) an inclined wall defining a lower boundary of the recess, the inclined wall directing fluid passing through the first holes outwardly and downwardly away from the recess.

* * * * *